United States Patent [19]

Robertson

[11] 4,345,523

[45] Aug. 24, 1982

[54] RAILWAY CAR STABILIZER

[76] Inventor: David H. Robertson, 35 Mill Brook Dr., East Longmeadow, Mass. 01028

[21] Appl. No.: 157,667

[22] Filed: Jun. 9, 1980

[51] Int. Cl.[3] ..... B61D 49/00; B61G 3/00; B61G 5/02

[52] U.S. Cl. ..... 105/1 A; 105/3; 213/8; 213/73; 213/75 R; 213/84

[58] Field of Search ..... 105/1 A, 1 R, 3, 4 R; 213/8, 23, 40 R, 40 D, 405, 73, 75 R, 81, 82, 89, 84, 85

[56] References Cited

U.S. PATENT DOCUMENTS

| | | | |
|---|---|---|---|
| 171,755 | 1/1876 | Ames | 213/82 |
| 425,445 | 4/1890 | Miller | 213/81 |
| 490,399 | 1/1893 | Roach | 213/75 R |
| 493,095 | 3/1893 | Knox | 213/75 R X |
| 720,398 | 2/1903 | Brand | 213/82 |
| 1,621,501 | 3/1927 | Floto | 213/8 X |
| 2,273,621 | 2/1942 | Piron | 213/75 R |
| 3,543,687 | 10/1967 | Ellzey | 213/75 R |
| 3,610,166 | 10/1971 | Ellzey | 105/3 X |
| 3,712,243 | 1/1973 | Pangalila | 105/1 A |
| 3,884,155 | 5/1975 | Maroshick | 105/4 R |

FOREIGN PATENT DOCUMENTS

| | | | |
|---|---|---|---|
| 321083 | 5/1920 | Fed. Rep. of Germany | 213/73 |

*Primary Examiner*—Joseph F. Peters, Jr.
*Assistant Examiner*—Howard Beltran
*Attorney, Agent, or Firm*—Chapin, Neal & Dempsey

[57] ABSTRACT

Stabilizing apparatus for preventing derailment of moving railway cars is provided. The apparatus includes a plurality of interconnected elongated members that overlie and are secured to a string of coupled cars. In the preferred embodiment, the elongated members are automatically connected at their ends by interengageable coupling members. The elongated members include cables that act as vibration dampers to prevent swaying and rolling motion of the cars on uneven track. The coupling members are specially configured to prevent a chain-reaction derailment of all the cars if one car derails.

6 Claims, 15 Drawing Figures

RAILWAY CAR STABILIZER

BACKGROUND OF THE INVENTION

The present invention relates to a stabilizing apparatus for coupled railway cars. More particularly, it relates to a stabilizing apparatus which prevents lateral motion or sway between the cars and which prevents car derailment.

Railway cars often travel over uneven pairs of track that have become warped with age or which were never laid properly. These inaccuracies cause the cars to sway and roll, with the movement often being excessive when the cars are moving over the track at even moderate speeds. When the movement does become excessive, one of the cars may tip over and cause a chain-reaction rollover of the other cars.

SUMMARY OF THE INVENTION

The present invention basically comprises a plurality of interconnected elongated members which overlie and are secured to a string of coupled railway cars, each member traversing substantially the entire length of a respective car and overhanging the car ends. The elongated members have coupling members at both of their ends, with adjacent elongated members being connected by the interengagement of the coupling members. In the preferred embodiment, the coupling members are similarly shaped hooks having shank portions with identically shaped recesses. A pair of adjacent coupling members can be connected by the hook of either coupling member being received in the recess of the other coupling member. The elongated members are cables that are fixedly connected to the top surface of respective cars. They act as vibration dampers to absorb destructive forces that otherwise cause swaying, rolling and derailment. The coupling members are specially configured to be automatically interconnected upon the movement of adjacent cars toward one another and automatically disengaged to prevent a chain-reaction derailment if one car derails.

The invention is not intended to supersede couplings ordinarily used for connecting the ends of railway cars but is used as auxiliary apparatus to stabilize a string of coupled cars.

It is the main object of the invention to provide a stabilizing apparatus that prevents swaying and rolling of railway cars as they move over uneven track.

It is a further object to provide an automatically connectable stabilizing apparatus for preventing undesired movement of railway cars upon uneven track.

It is another object to provide a stabilizing apparatus that becomes automatically disengaged to prevent a chain-reaction derailment of an entire string of railway cars upon the derailment of a single car.

It is yet another object to prevent swaying and rolling by an apparatus that is simple in design and economical in cost.

These and other objects of the invention, as well as many of the attendant advantages thereof, will become more readily apparent when reference is made to the following description taken in conjunction with the accompanying drawings.

DETAILED DESCRIPTION OF THE DRAWINGS

Figures 1, 2:
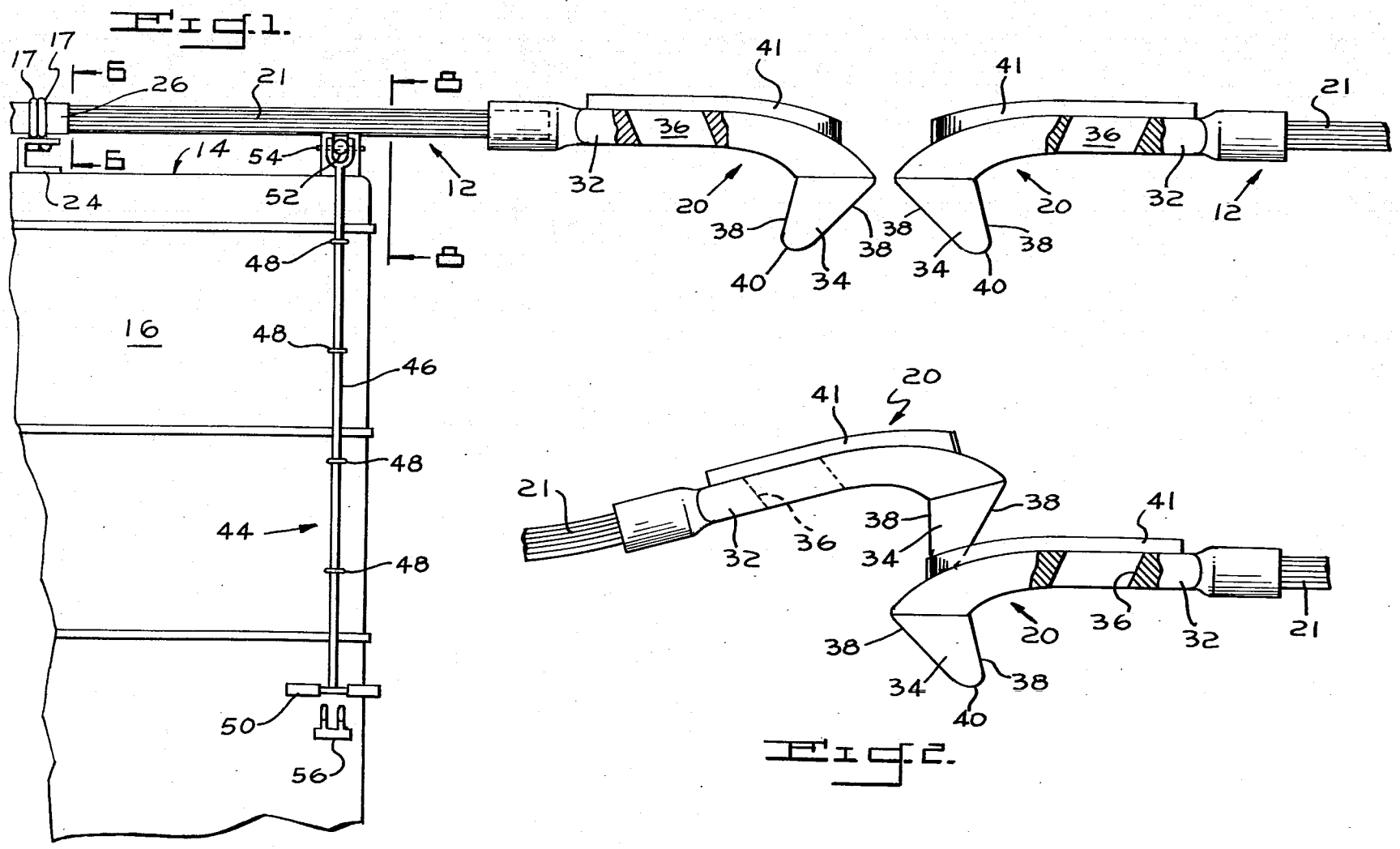
FIG. 1 is a fragmentary plan view of two railway cars with adjacent, unconnected elongated members of a stabilizing apparatus constructed in accordance with the present invention.
FIG. 2 is a plan view of two unconnected coupling members shown in the FIG. 1 stabilizer but in different relative positions than illustrated in FIG. 1.
Figure 3:
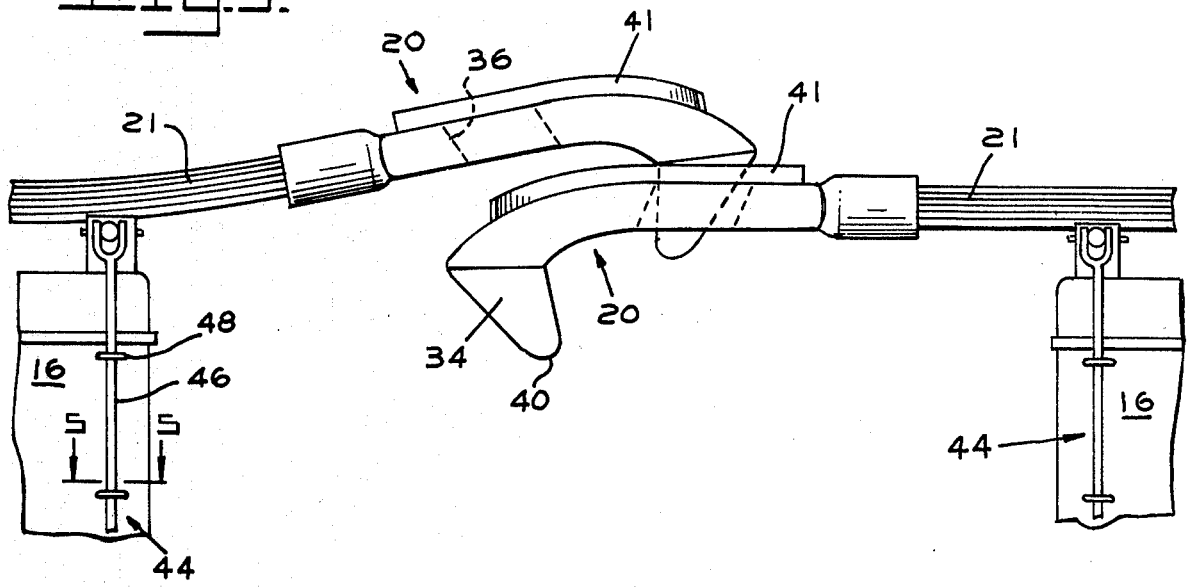
FIG. 3 is a plan view of two reailway cars interconnected by the stabilizing apparatus of FIG. 1.

Referring to the drawings in detail, a stabilizer for preventing undesired movement of railway cars is illustrated and generally designated by the reference numeral 10. The stabilizer includes a plurality of flexible elongated members 12 that overlie and are attached to the top surface 14 of railway cars 16 by a series of guide bolts 17 and clamps 18. The members 12 are automatically connectable end-to-end by a plurality of interengageable coupling members 20. When interconnected, the elongated members 12 are bent in response to swaying and rolling movements of the cars 16. The members 12 act as vibration dampers and absorb the bending forces transmitted by the cars to prevent a resonating buildup of these forces and to limit initial undesired movements of the cars.

Figure 6:
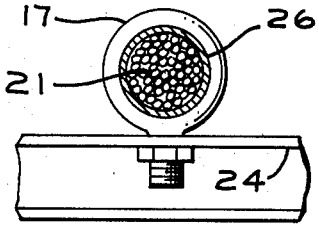
FIG. 6 is a cross-sectional view taken along line 6—6 of FIG. 1, which illustrates a supporting guide structure for an elongated member.
Figure 7:
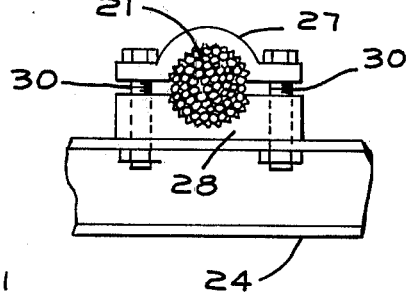
FIG. 7 is a cross-sectional view taken along line 7—7 of FIG. 9, which illustrates a clamp for fixedly securing an elongated member to a car.

As best shown in FIGS. 1, 7, 9 and 10, the elongated members 12 include flexible steel cables 21 that are rotatably received within spaced sets of the guide bolts 17. The bolts 17 are centrally mounted along the top surface 14 of a car 16 and are secured to that surface by parallel I-beams 24. Two of the sets of bolts 17 each include a pair of eye bolts with a wear band 26 between the member 12 and the pair (see FIG. 6). Each member 12 is attached at its mid-length by firm gripping means (here, two clamps 18). All of the clamps 18 have a top-half 27 and a bottom-half 28 that are interconnected by fasteners 30. Each half 27, 28 has cerrated edges to fixedly grasp an elongated member 12 between the fastened halves.

As best shown in FIGS. 1–4, the elongated members have coupling members 20 at each of their ends. The coupling members are solid, cast steel hooks that resemble "rams' heads" and include a shank portion 32, a leg 34 attached to the shank portion 32 angularly offset thereto, and a recess 36 in the shank for removedly receiving the leg 34 of any of the other coupling members. As used hereafter, the phrase "interengageable coupling members 20" is used to denote the receivability of a portion of any member 20 (here, leg 34) within a retaining means (here, recess 36) of any other members 20. Each leg 34 has two flat sides 38 and is rounded at its end 40. Each recess 36 is canted with respect to the longitudinal axis of its associated shank 32.

Adjacent coupling members 20 are automatically connectable upon movement of adjacent railway cars 16 toward one another. From their positions shown in FIG. 1, the leg 34 of one of the coupling members 20 slides into a pair of guide sides 41 welded to the shank portion 32 of another member 20 (See FIG. 2). Each guide side 41 is flared at one end 42 to assist alignment of the leg 34 with the associated recess 36 of the adjacent member 20. From their positions shown in FIG. 2, the members 20 continue to move together until the leg 34 is received in the associated recess (see FIGS. 3 and 4). In this position, the flat sides 38 of the leg 34 cooperate with the straight-edged perimeter of the recess 36 to prevent relative lateral movement of the two adjacent members 20.

Figure 8:
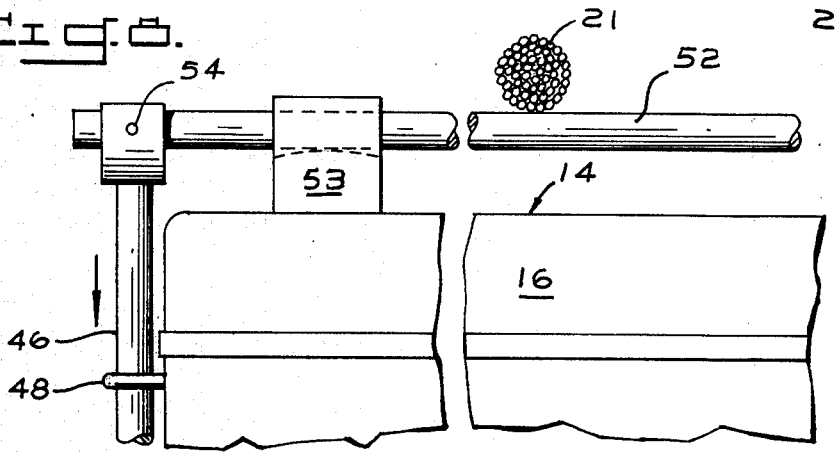
FIG. 8 is a plan view taken along line 8—8 of FIG. 1, which illustrates the control for disconnecting adjacent coupling members.
Figure 9:
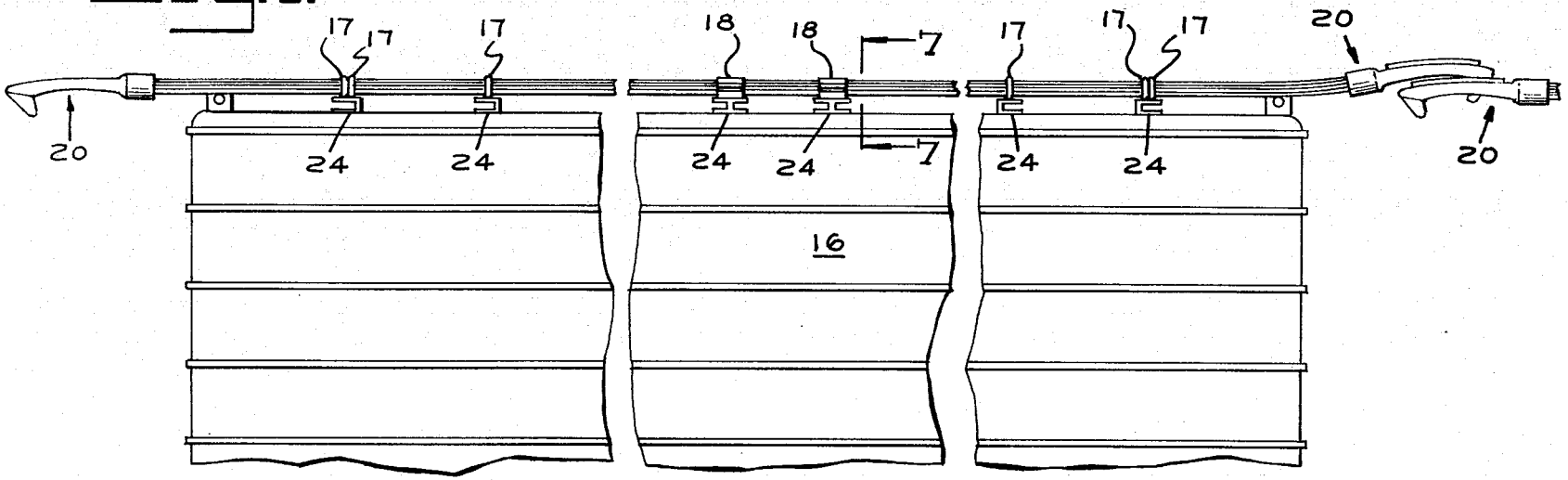
FIG. 9 is a side plan view of an elongated member attached to an underlying railway car.
Figure 10:
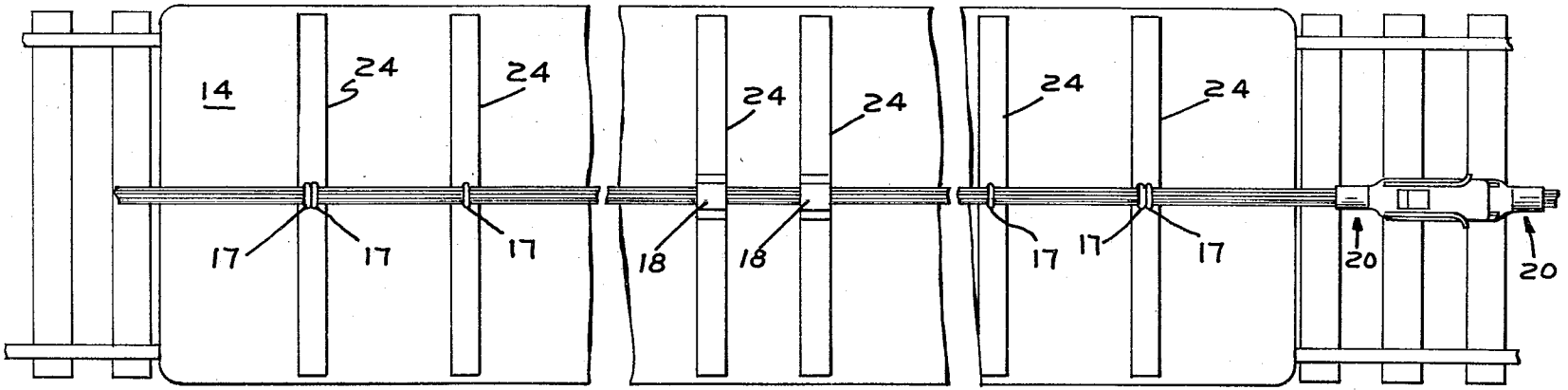
FIG. 10 is a top plan view of the elongated member and car of FIG. 9.

Engaged coupling members 20 are disconnected upon the use of a manual control 44. The control 44 includes a vertically extending push rod 46 supported along a side of a car 16 by a plurality of U-shaped guides 48. At one end the rod 46 is attached to a handle 50. At its other end the rod 46 is attached to a lever rod 52 (by a swivel pin 54) that is perpendicular to and underlies an associated cable 21. The push rod 52 is spaced from the cable. In this position, the lever rod is supported by a pair of spaced blocks 53 atop the car 16 (see FIG. 8) and the handle 50 is retained within a latch 56.

Figure 4:
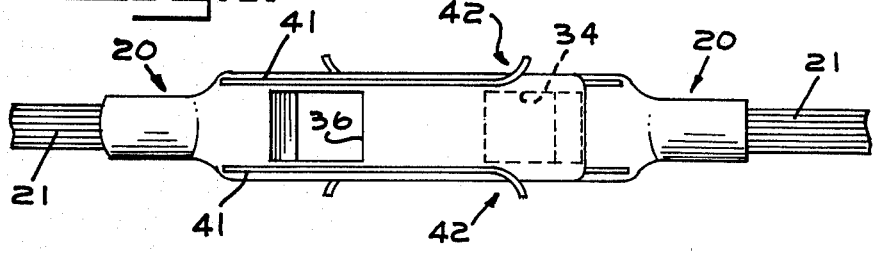
FIG. 4 is a top plan view of the two coupling members illustrated in FIG. 3.
Figure 5:
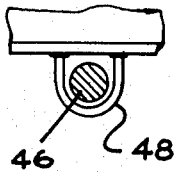
FIG. 5 is a cross-sectional view taken along line 5—5 of FIG. 3, which illustrates a guide of a control for disconnecting the coupling members.

The handle 50 can be removed from the latch 56 by an operator (not shown) pulling the handle downward and then lifted to raise a leg 34 from a recess 36 in which the leg was received (see FIG. 4). This assists in the disengagement of the coupled members 20 upon the movement of their associated cars 16 away from one another.

Figure 11:
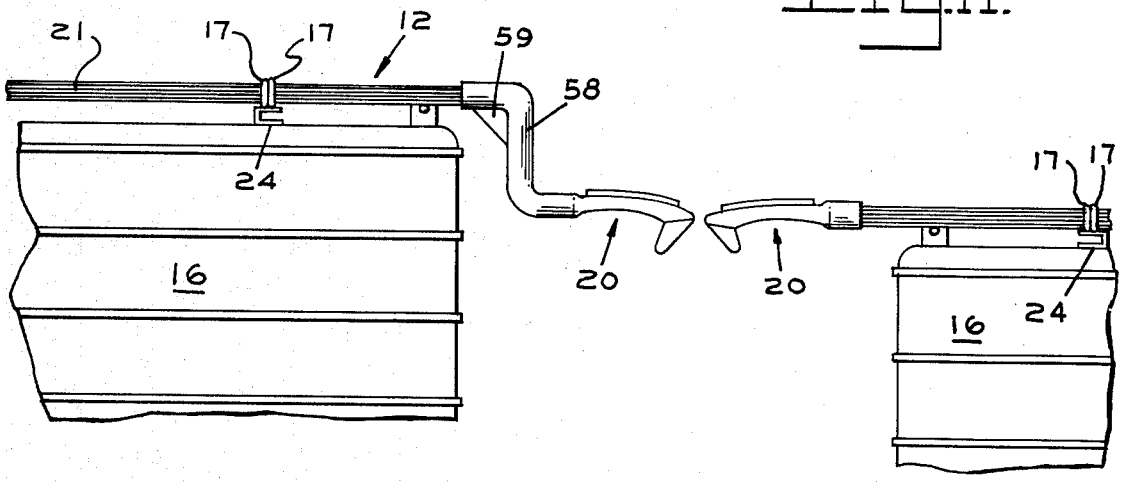
FIG. 11 is a plan view of an alternate embodiment of a coupling member to connect adjacent elongated members that are secured to cars of different height.

FIG. 11 illustrates an alternate embodiment of a coupling member 20. The illustrated member 20 is used to connect elongated members 12 on cars 16 of different height. It includes a lowering elbow 58 (with a reinforcing rib 59) for this purpose.

Figure 12:
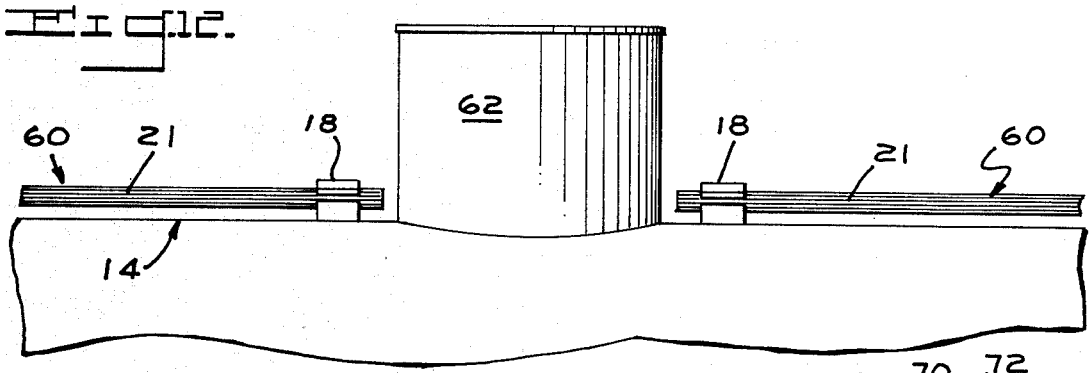
FIG. 12 is an alternate embodiment of a segmented, elongated member used in cars having a stepped top surface.

An alternate embodiment of the elongated member 12 is shown in FIG. 12. The alternate embodiment is a segmented member 60 that is used where the top surface 14 of a car has a step or discontinuity 62 in height. The segmented member 60 is secured by clamps 18 adjacent to the discontinuity.

Figure 13:
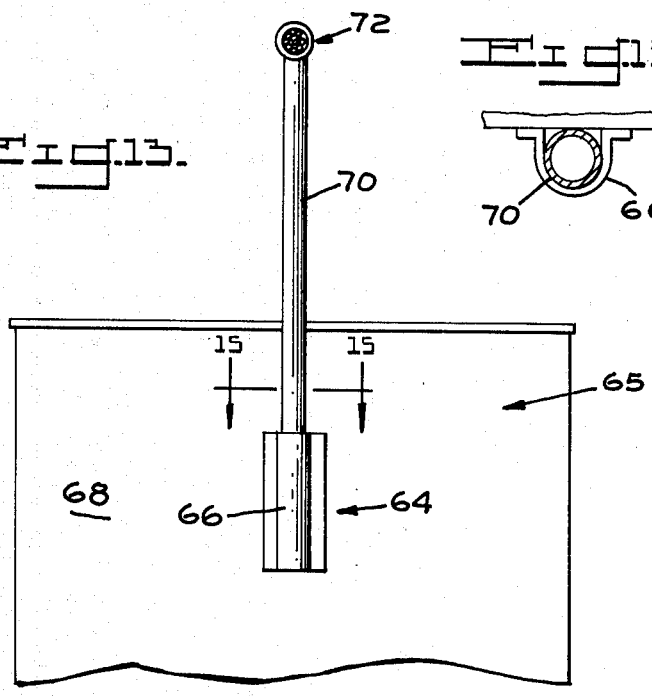
FIG. 13 is a plan view of an attachment secured to the side of a railway car to support an elongated member over an open-top railway car.
Figure 15:
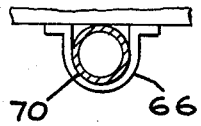
FIG. 15 is a cross-sectional view taken along line 15—15 of FIG, 13.
Figure 14:
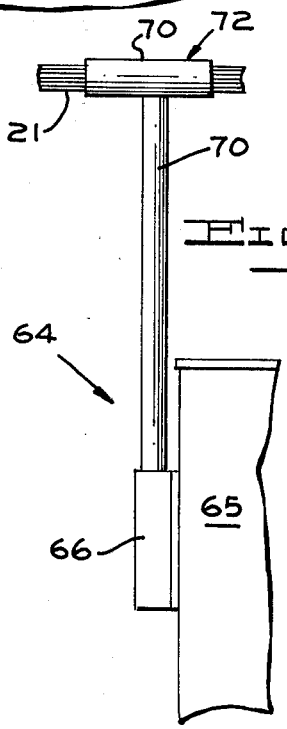
FIG. 14 is a side plan view of the attachment support illustrated in FIG, 13.

FIGS. 13–15 illustrate an adapter 64 used to secuure elongated members 12 to open-top cars 65. The adapter includes a pipe pocket 66 attached to each side end 68 of such a car. A T-shaped pipe 70 is housed within the pocket and receives a cable 21 through its upper portion 72.

During movement of a string of coupled railway cars upon uneven track, the disclosed stabilizer prevents swaying of the cars by the connected elongated members carrying cars over the track until those cars regain their line of travel on the next rail. The system also prevents twisting and rolling movements of the cars by the cables damping any forces that cause these two undesired movements. In the embodiments of FIGS. 1–12, the cables not only dampen these forces but also transmit the remainder of any of these forces (after damping) to the center of the cars, where the cars are most stable. The remaining forces are transmitted to the central car portions by the clamps 18 attached to the top surface 14 of the cars. Moreover, the unique configuration of the coupling members 20, i.e., their legs 34 and recesses 36, prevent a chain-reaction derailment of an entire string of cars when one car does derail. The configuration achieves this by permitting automatic disengagement of the legs of both coupling members 20 of the derailed car from the recesses 36 of the members 20 of adjacent cars in which they were received.

The disclosed invention may be embodied in other specific forms without departing from the spirit or essential attributes of the invention. Accordingly, reference should be made primarily to the appended claims, rather than to the foregoing specification, to determine the scope of the invention.

Having thus described the invention, what is claimed is:

1. Apparatus for stabilizing a string of coupled railway cars during movement of the cars over railway tracks, said apparatus comprising:

(a) a plurality of flexible cables overlying an upper surface of said cars, each cable traversing substantially the entire length of a respective one of said cars and overhanging at least one end of said one car, said cable being secured to the upper surface of said cars by a gripping means which fixedly holds a section of the cable in a stationary position;

(b) each cable having two end portions which extend from opposite sides of the gripping means with at least one of the end portions having a coupling member attached thereto, adjacent ones of said coupling members being engaged to connect adjacent cars, whereby rolling motion of one of said adjacent connected cars about the car's longitudinal axis causes one of the end portions of the cable secured to said car to twist about said axis, while the gripping means for said cable prevents the cable's other end portion from twisting, whereby said twisted cable portion absorbs torsional forces imparted to it by said car and said twisted cable portion and said gripping means inhibit the transmission of said torsional forces to another of the adjacent connected cars.

2. The apparatus of claim 1 wherein tthe gripping means comprises a clamp which grasps the cable near its mid-length.

3. The apparatus of claim 1 wherein the coupling members are interengageable.

4. The apparatus of claim 1 wherein the engaged coupling members are adapted to be automatically disengaged upon a predetermined amount of relative movement of adjacent cars toward one another.

5. The apparatus of claim 1 wherein the coupling members include means to inhibit their relative lateral movement after their engagement.

6. The apparatus of claim 1 wherein said coupling members comprise hooks, each including a shank portion, a leg extending from said shank portion and angularly offset with respect thereto, said shank portion including a recess therein adapted to receive the leg of an adjacent coupling member.

* * * * *